US007564047B2

(12) United States Patent
Arimoto et al.

(10) Patent No.: US 7,564,047 B2
(45) Date of Patent: Jul. 21, 2009

(54) RADIATION IMAGE CONVERSION PANEL, AND MANUFACTURING METHOD AND CASSETTE THEREOF

(75) Inventors: Tadashi Arimoto, Tokyo (JP); Takafumi Yanagita, Tokyo (JP); Yoshihiro Gorouya, Tokyo (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/924,990

(22) Filed: Oct. 26, 2007

(65) Prior Publication Data

US 2008/0105832 A1 May 8, 2008

(30) Foreign Application Priority Data

Nov. 7, 2006 (JP) ..... 2006-301333

(51) Int. Cl.
*G21K 4/00* (2006.01)

(52) U.S. Cl. ..... 250/484.4

(58) Field of Classification Search ..... 250/484.4
See application file for complete search history.

(56) References Cited

U.S. PATENT DOCUMENTS

| | | | | |
|---|---|---|---|---|
| 2003/0160187 | A1 * | 8/2003 | Nakano et al. | 250/484.4 |
| 2006/0038135 | A1 * | 2/2006 | Hosoi | 250/484.4 |
| 2006/0065851 | A1 * | 3/2006 | Isoda et al. | 250/484.4 |
| 2007/0090100 | A1 * | 4/2007 | Yonai et al. | 219/121.69 |
| 2008/0011961 | A1 * | 1/2008 | Shoji et al. | 250/370.11 |
| 2008/0152788 | A1 * | 6/2008 | Nagano | 427/74 |

FOREIGN PATENT DOCUMENTS

JP 2003248093 A * 9/2003

* cited by examiner

*Primary Examiner*—David P Porta
*Assistant Examiner*—Marcus H Taningco
(74) *Attorney, Agent, or Firm*—Lucas & Mercanti, LLP

(57) ABSTRACT

An objective is to provide a radiation image conversion panel exhibiting no generation of cracks in a phosphor layer, easy cutting, improved image and excellent productivity, and also to provide a manufacturing method and a cassette thereof. Disclosed is a radiation image conversion panel possessing a support and provided thereon, a phosphor layer possessing phosphor having a columnar crystal structure, wherein a region in which no phosphor layer is provided on a surface of the support is within 0.5 mm from an edge of the support.

9 Claims, 1 Drawing Sheet

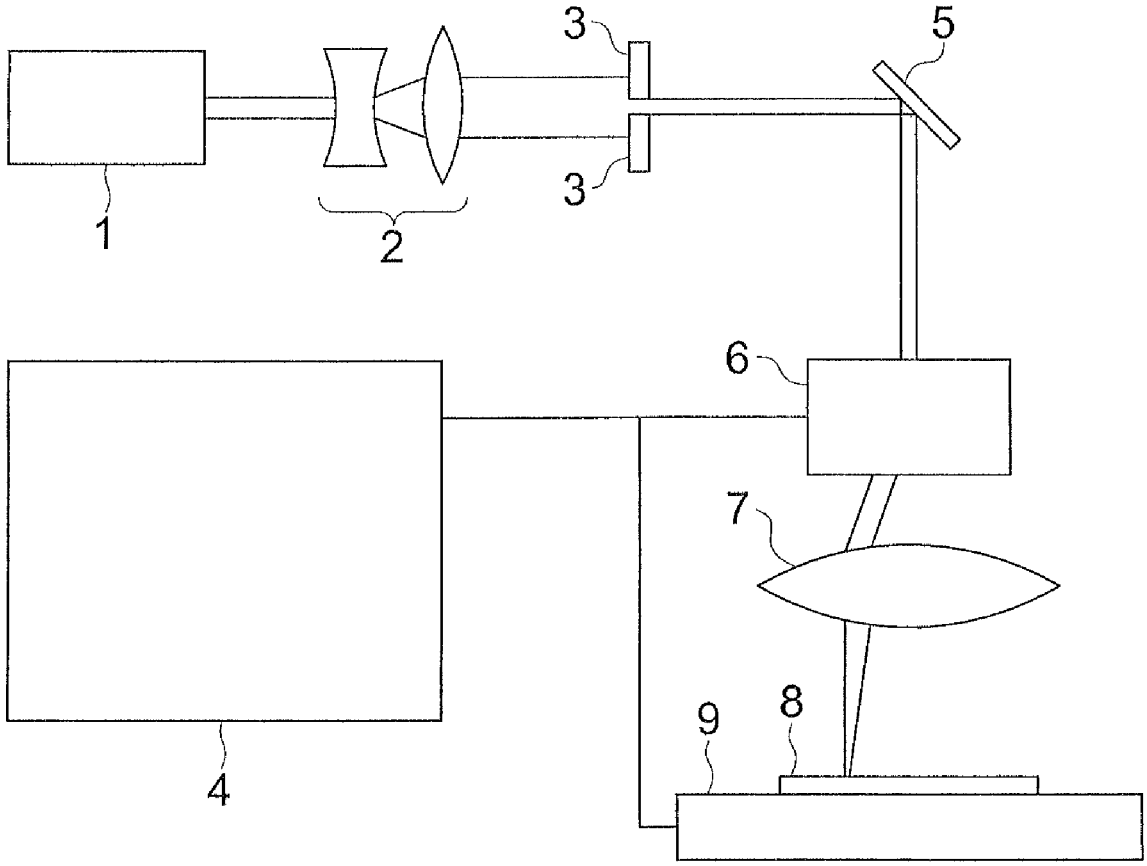
3
5
3
1
2
6
7
9
8
4

RADIATION IMAGE CONVERSION PANEL, AND MANUFACTURING METHOD AND CASSETTE THEREOF

This application claims priority from Japanese Patent Application No. 2006-301333 filed on Nov. 7, 2006, which is incorporated hereinto by reference.

TECHNICAL FIELD

The present invention relates to a radiation image conversion panel utilized for X-ray photography, and to a manufacturing method and a cassette thereof.

BACKGROUND

Known is a technique of cutting with a punching blade for a coat type plate obtained by coating phosphor particles dispersed in binder on a support (refer to Patent Documents 1 and 2, for example), which exhibits excellent productivity since it is possible to cut plates into desired size out of a largesized plate.

A radiation image conversion panel comprising a support and provided thereon, a phosphor layer having elongated columnar crystals (hereinafter, also referred to simply as crystals) has recently been disclosed (refer to Patent Document 3, for example) The phosphor layer formed via an evaporation method is very brittle because of containing no binder, and cutting is very difficult since cracks are generated when conducting a process of using a punching blade. Thus, there has been a problem such that an evaporation type phosphor plate produces low productivity, and this is desired to be improved.

(Patent Document 1) Japanese Patent O.P.I. Publication No. 11-223891

(Patent Document 2) Japanese Patent O.P.I. Publication No. 2004-154913

(Patent Document 1) Japanese Patent O.P.I. Publication No. 2-58000

SUMMARY

It is an object of the present invention to provide a radiation image conversion panel exhibiting no generation of cracks in a phosphor layer, easy cutting, improved image and excellent productivity, and also to provide a manufacturing method and a cassette thereof.

BRIEF DESCRIPTION OF THE DRAWING

The FIGURE is a schematic diagram showing an example of cutting a phosphor plate of the present invention by laser light.

DESCRIPTION OF THE PREFERRED EMBODIMENTS

The above object of the present invention is accomplished by the following structures.

(Structure 1) A radiation image conversion panel comprising a support and provided thereon, a phosphor layer comprising phosphor having a columnar crystal structure, wherein a region in which no phosphor layer is provided on a surface of the support is within 0.5 mm from an edge of the support.

(Structure 2) The radiation image conversion panel of Structure 1 wherein columnar crystals at an edge of the phosphor layer are fused.

(Structure 3) The radiation image conversion panel of Structure 1 or 2, wherein the support and provided thereon, the phosphor layer are cut by laser light.

(Structure 4) The radiation image conversion panel of Structure 3, wherein the laser light is UV laser.

(Structure 5) The radiation image conversion panel of any one of Structures 1-4, wherein the support comprises a metal-coated polymer film.

(Structure 6) The radiation image conversion panel of Structure 5, wherein the metal comprises aluminum or silver as a principal component.

(Structure 7) The radiation image conversion panel of Structure 5 or 6, wherein the polymer film is made of any one of polyimide, polyethylene naphthalate, polyethersulfone and polysulfone as a principal component.

(Structure 8) The radiation image conversion panel of any one of Structures 1-7, wherein the phosphor layer contains the phosphor comprising alkali halide represented by Formula (1) as a principal substance:

$$M^1X \cdot aM^2X'_2 \cdot bM^3X''_3 : eA \qquad \text{Formula (1)}$$

wherein $M^1$ is at least one alkali metal atom selected from the group consisting of Li, Na, K, Rb and Cs; $M^2$ is at least one divalent metal atom selected from the group consisting of Be, Mg, Ca, Sr, Ba, Zn, Cd, Cu and Ni; $M^3$ is at least one trivalent metal atom selected from the group consisting of Sc, Y, La, Ce, Pr, Nd, Pm, Sm, Eu, Gd, Tb, Dy, Ho, Er, Tm, Yb, Lu, Al, Ga and In; X, X' and X" each are at least one halogen selected from the group consisting of F, Cl, Br and I; A is at least one metal atom selected from the group consisting of Eu, Tb, In, Cs, Ce, Tm, Dy, Pr, Ho, Nd, Yb, Er, Gd, Lu, Sm, Y, Tl, Na, Ag, Cu and Mg; and a, b and e each are a value within the range of $0 \leqq a < 0.5$, $0 \leqq b < 0.5$ and $0 < e \leqq 0.2$, respectively.

(Structure 9) The radiation image conversion panel of any one of Structures 1-8, wherein the phosphor comprises stimulable phosphor.

(Structure 10) A method of manufacturing the radiation image conversion panel of any one of Structures 1-9, employing infrared laser.

(Structure 11) A cassette comprising the radiation image conversion panel of any one of Structures 1-9.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, the present invention will further be described in detail.

It is necessary in the present invention that a region in which no phosphor layer containing phosphor formed from columnar crystals is provided on a surface of a support is within 0.5 mm from an edge of the support. When the region in which no phosphor layer is provided on the support surface, that is, the defect portion of the phosphor exceeds 0.5 mm, image quality is largely deteriorated. The region in which no phosphor layer is provided on the support surface, that is, the defect portion of the phosphor is preferably within 0.2 mm, and more preferably within 0.1 mm.

In a coat type phosphor plate, a cutting method employing a punching blade is commonly known, but when this method is applied to an evaporation type phosphor plate, it is difficult to keep the defect portion of the phosphor layer within 0.5 mm, since cracks are generated on the phosphor layer. For example, a phosphor plate having a defect portion of the phosphor layer of less than 0.5 mm can be obtained by a cutting method employing laser light.

In addition, the region in which no phosphor layer is provided on the support surface can be obtained by evaluating the maximum value of length from the support edge to the phosphor edge after observing peripheral portions of the phosphor plate from atop a phosphor layer with an optical microscope, a loupe or such.

When a phosphor plate is cut by laser light, for example, columnar crystals located at the edge of a cut phosphor layer are fused via heat. It was understood that a radiation image conversion panel exhibiting excellent moisture resistance was obtained by protecting such the shaped phosphor plate with moisture resistant films.

It presumably appears that independency of crystal edge portions dissipates via fusion of columnar crystals, and damage to a moisture resistant film is reduced, whereby this prevents moisture from entering a phosphor layer from the outside. As to fusion of columnar crystals, evaluation can be made via SEN observation of the cross-section of the phosphor layer. The fusion of columnar crystals herein means a situation where independency of each of columnar crystals dissipates, and these columnar crystals are integrated. It is preferable that a fused region is within 0.5 mm from an edge of the support via observation from atop a phosphor layer. When exceeding this region, image quality tends to be deteriorated.

In the present invention, laser usable for cutting of a phosphor plate is not particularly limited, and examples thereof include infrared laser such as Nd:YAG laser, semiconductor laser, Nd:YLF laser, Nd:BEL laser, Nd:$YVO_4$ laser, LNP laser, Ti:sapphire laser, alexandrite laser, Co—$MgF_2$ laser, Cr-GSGG laser, emerald laser, provskite laser, Er-YLF laser or Er-glass laser; visible light laser such as ruby laser, He—Ne laser, $Co_2$ laser, Ar ion laser, He—Cd laser, Cu laser, Au laser, Sr laser, Kr ion laser, Ne ion laser, Xe ion laser, Co laser, hydrogen halide laser, $O_2$—I laser, Dye laser, the second harmonic wave of Nd:YAG or the third harmonic wave of Nd:YAG; and UV laser such as ArF excimer laser, KrF excimer laser, XeF excimer laser, ArCl excimer laser, KrCL excimer laser, XeCl excimer laser, $N_2$ laser, Au laser or the fourth harmonic wave of Nd:YAG. Of these, UV laser is preferable.

The FIGURE is a schematic diagram showing an example of cutting a phosphor plate of the present invention by laser light.

The fourth harmonic wave of Nd:YAG laser (a wavelength of 266 nm) is emitted from laser light source 1 (Nd:YAG laser oscillator fitted with a wavelength conversion unit, for example) at a pulse energy of 0.1 mJ/pulse and at a pulse width of 50 ns. In addition, a fundamental wave and a harmonic wave of a solid-state laser such as YAG, YLF, $YVO_4$ or such, or laser light such as $Co_2$ laser are usable. A laser beam enlarged its beam diameter, and is reflected at reflection mirror 5 via expander 2 from which the beam is output as parallel light to enter galvanoscanner 6. Galvanoscanner 6 equipped with 2 swingablereflection mirrors scans in the two-dimensional direction at high speed. Laser beam which exits from galvanoscanner 6 enters phosphor plate 8 as a processed object placed on XY stage 9 via fθ lens 7 to conduct cutting.

A polymer film is preferably used for a support of the present invention in view of a cutting property.

The polymer film used for the support is not particularly limited, and examples thereof include polyethylene terephthalate, polyethylene naphthalate, cellulose acetate, polyamide, polyimide, epoxy, polyamideimide, bismaleimide, a fluorine resin, acryl, polyurethane, nylon 12, nylon 6, polycarbonate, polyphenylenesulfide, polyethersulfone, polysulfone, polyetherimide, and polyether ether ketone, but when a phosphor is formed via vapor deposition, it is preferred that a glass transition temperature of the support is not 100° C. or less so as not to deform the support via heat.

As a polymer film employed for the support of the present invention, polyimide, polyethylene naphthalate, polyethersulfone and polysulfone are preferable in view of heat resistance, but polyimide is more preferable.

The effect of the present invention is preferably produced by employing the foregoing support including the polymer film.

A technique relating to a plate having an amorphous carbon support coated by an aluminum layer is disclosed in Japanese Patent O.P.I. Publication No. 2004-251883, but when a polymer film, unlike inflexible amorphous carbon, is coated with metal, the continuous processing in the form of a roll becomes possible, whereby productivity can be largely improved.

The method in which a polymer film coated with metal is not specifically limited, but examples thereof include an evaporation method, a sputtering method, a metal foil lamination method or such. Of these, a sputtering method is preferable in view of adhesion to a polymer film.

In the present invention, a metal-coated polymer film preferably has a surface resistance of at least 80%, and more preferably has a surface resistance of at least 90%. When a support has a surface resistance of at least 90%, luminance is largely improved since emission of a phosphor can be efficiently taken out. Kinds of the coated metal ate not specifically limited, and examples thereof include aluminum, silver, platinum, gold, copper, iron, nickel, chromium, cobalt and so forth. Of these, metal containing aluminum or silver as a principal component is preferable in view of reflectance and corrosion.

Phosphor of the present invention is referred to as one in which after the phosphor is excited by X-ray, visible light is emitted immediately or after receiving stimulation of infrared light or such in the relaxation process. The phosphor is not specifically limited, but phosphor from which visible light is emitted by receiving stimulation of infrared light or such is preferable. In addition, the phosphor of the present invention comprises a stimulable phosphor.

A commonly known phosphor can be employed for phosphor used in radiation image conversion panel of the present invention, but the preferable phosphor utilized in the present invention is phosphor represented by foregoing Formula (1).

In the phosphor represented by foregoing Formula (1), $M^2$ is at least one alkali metal atom selected from the group consisting of Li, Na, K, Rb and Cs. Of these, at least one alkali metal atom selected from the group consisting of Rb and Cs is preferable, and Cs is more preferable.

$M^2$ is at least one divalent metal atom selected from the group consisting of Be, Mg, Ca, Sr, Ba, Zn, Cd, Cu and Ni. Among these atoms, divalent metal atoms selected from the group consisting of Be, Mg, Ca, Sr and Ba are preferably usable.

$M^3$ is at least one trivalent metal atom selected from the group consisting of Sc, Y, La, Ce, Pr, Nd, Pm, Sm, Eu, Gd, Tb, Dy, Ho, Er, Tm, Yb, Lu, Al, Ga and In. Among these atoms, trivalent metal atoms selected from the group consisting of Y, Ce, Sm, Eu, Al, La, Gd, Lu, Ga and In are preferably usable.

A is at least one metal atom selected from the group consisting of Eu, Tb, In, Cs, Ce, Tm, Dy, Pr, Ho, Nd, Yb, Er, Gd, Lu, Sm, Y, Tl, Na, Ag, Cu and Mg.

X, X' and X" each are at least one halogen selected from the group consisting of F, Cl, Br and I. At least one halogen selected from the group consisting of Cl, Br and I is preferable in view of improved luminance of stimulated emission from the phosphor, and at least one halogen selected from the group consisting of Br and I is more preferable.

The phosphor represented by foregoing Formula 1 is prepared by the following manufacturing method.

An acid (HI, HBr, HCl or HF) is added into carbonate as phosphor raw material so as to make the following composition and mixed while stirring. Then the resulting is filtered at the neutral point, and moisture of the filtrate is removed by evaporation to prepare the following crystals.

As the phosphor raw material:

(a) At least one compound selected from the group consisting of NaF, NaCl, NaBr, NaI, KF, KCl, KBr, KI, RbF, RbCl, RbBr, RbI, CsF, CsCl, CsBr and CsI is used.

(b) At least one compound selected from the group consisting of $MgF_2$, $MgCl_2$, $MgBr_2$, $MgI_2$, $CaF_2$, $CaCl_2$, $CaBr_2$, $CaI_2$, $SrF_2$, $SrCl_2$, $SrBr_2$, $SrI_2$, $BaF_2$, $BaCl_2$, $BaBr_2$, $BaBr_2.2H_2O$, $BaI_2$, $ZnF_2$, $ZnCl_2$, $ZnBr_2$, $ZnI_2$, $CdF_2$, $CdCl_2$, $CdBr_2$, $CdI_2$, $CuF_2$, $CuCl_2$, $CuBr_2$, $CuI_2$, $NiF_2$, $NiCl_2$, $NiBr_2$ and $NiI_2$.

(c) A compound having a metal atom selected from the group consisting of Eu, Tb, In, Cs, Ce, Tm, Dy, Pr, Ho, Nd, Yb, Er, Gd, Lu, Sm, Y, Tl, Na, Ag, Cu and Mg in the foregoing Formula (1) is used.

(d) At least one metal atom selected from the group consisting of Eu, Tb, In, Ce, Tm, Dy, Pr, Ho, Nd, Yb, Er, Gd, Lu, Sm, Y, Tl, Na, Ag, Cu and Mg is used as activator A.

In a compound represented by Formula (1), "a" is in the range of $0 \leqq a < 0.5$, and preferably in the range of $0 \leqq a < 0.01$; "b" is in the range of $0 \leqq b < 0.5$, and preferably in the range of $0 \leqq b \leqq 0.01$; and "e" is in the range of $0 < e \leqq 0.2$, and preferably in the range of $0 < e \leqq 0.1$.

Phosphor raw materials (a)-(d) are weighed so as to give the mixture composition in the range of the above-described numerical values, and dissolved in pure water.

In this case, the raw materials may be sufficiently mixed by a mortar, a ball mill or a mixer mill.

After adding a predetermined acid so as to adjust pH value C of the resulting solution to $0 < C < 7$, moisture is evaporated out.

Next, the resulting raw material mixture is put into a heat resistive vessel such as a quartz crucible or an alumina crucible, and burned in an electric furnace. A burning temperature of 500-1000° C. is preferable. The preferable burning time is 0.5-6 hours, though the time depends on a filling amount of the raw material mixture, the burning temperature and so forth.

As the burning atmosphere, a weak reduction atmosphere such as a nitrogen gas atmosphere with a small amount of hydrogen gas and a carbon dioxide gas atmosphere with a small amount of carbon mono-oxide, a neutral atmosphere such as a nitrogen gas atmosphere and an argon gas atmosphere, and a weak oxidation atmosphere containing a small mount of oxygen gas are preferable.

In addition, emission Luminance of the phosphor can be further enhanced by that the phosphor once burned under the foregoing conditions is removed from the electric furnace and powdered; thereafter the powder of the burned materials is re-charged into the heat resistance vessel, and re-burned in the electric furnace under the same conditions. When the burned material is cooled from the burning temperature to room temperature, it may be cooled in the weak reduction or the neutral atmosphere even though the desired phosphor can be obtained by taking out the burned material from the electric furnace, and standing in air atmosphere to be cooled. Emission luminance caused by stimulated luminescence of the resulting phosphor can be further enhanced by that the burned material is moved from the heating portion to the cooling portion in the electric furnace to be rapidly cooled in the weak reduction atmosphere, the neutral atmosphere or the weak oxidation atmosphere.

The phosphor of the present invention is formed by a vapor deposition method.

As the method of vapor-depositing the phosphor, an evaporation method, a sputtering method, a CVD method, an ion-plating method and others are applicable.

In the present invention, the following method can be provided, for example.

In the case of the evaporation method as the first method, a support is placed in an evaporator and the inside of the evaporator is evacuated until a vacuum degree reaches about $1.333 \times 10^{-4}$ Pa.

Subsequently, at least one of phosphors is vaporized via heat, and deposited by a resistance heating method or an electron beam method to grow the phosphor to a desired thickness.

As a result, a phosphor layer containing no binder is formed, but it is also possible to divide the foregoing evaporation process into plural processes to form the phosphor layer.

In the foregoing evaporation process, co-evaporation carried out employing plural resistance heaters or electron beam devices to synthesize an intended phosphor and form a phosphor layer on a support.

After completing the evaporation, a protective layer is provided on the side opposite to the support side of the foregoing phosphor layer, if desired, to prepare a radiation image conversion panel of the present invention. In addition, a procedure is applicable in which a phosphor layer is formed on a protective layer and then a support is provided.

In the above-described evaporation method, an evaporated subject (a support, a protective layer or an intermediate layer) may be cooled or heated, if desired.

The phosphor layer may be subjected to a heat treatment after completing evaporation. Further, In the above-described evaporation method, reaction evaporation may be conducted by introducing gas such as $O_2$, $H_2$ or such.

In a sputtering method as the second method, a support comprising a protective layer and an intermediate layer is placed in a sputtering apparatus similarly to the evaporation method, and the inside of the apparatus is once evacuated to set to a vacuum degree of $1.33 \times 10^{-4}$ Pa, and then inert gas such as Ar, Ne or such is introduced into the sputtering apparatus as a sputtering gas to set to a gas pressure of approximately $1.333 \times 10^{-1}$ Pa. Next, the sputtering is conducted by using the foregoing phosphor as a target to grow a phosphor layer on the above-described support to a desired thickness.

In the above-described sputtering process, various application treatments are usable similarly to the evaporation method.

A CVD method is applicable as the third method, and an ion plating method is also applicable as the fourth method.

A growing rate of the phosphor layer in the above-described vapor deposition method is preferably 0.05-300 μm/min. In the case of a growing rate of less than 0.05 μm/min, productivity of the radiation image conversion panel in the present invention is to be deteriorated. In the case of a growing rate exceeding 300 μm/min, the growing rate is difficult to be controlled.

When the radiation image conversion panel is prepared by the foregoing evaporation method or the sputtering method, filling density of the phosphor can be increased because of no presence of binder, whereby the radiation image conversion panel can be preferably obtained in view of sensitivity and resolution.

The thickness of the phosphor layer may depend on the intended use and the kind of the phosphor, but a thickness of 50 μm-1 mm is desired in view of produced effects of the present invention, a thickness of 100 μm-800 μm is preferable, and a thickness of 100 μm-700 μm is more preferable.

When the phosphor layer is prepared by the vapor deposition method, temperature of a support on which the phosphor layer is formed is preferably set to at least 50° C., more preferably set to at least 80° C., and most preferably set to 100-400° C.

Further, the phosphor layer of the present invention preferably has a reflectance of at least 20% in view of preparation of a radiation image conversion panel exhibiting high sharpness, more preferably has a reflectance of at least 30%, and still more preferably has a reflectance of at least 40%. In addition, the upper limit is 100%.

The phosphor layer formed on a support exhibits excellent directionality, and stimulated emission light and stimulated luminescence have high directionality since the layer contains no binder. Consequently, the thicker phosphor layer can be produced via a radiation image conversion panel having a dispersion type phosphor layer in which the phosphor is dispersed in the binder. Further, sharpness of images is improved since scattering of stimulated emission light in the phosphor layer is reduced.

Further, spacing between columnar crystals may be filled with a filler such as a binder to strengthen the phosphor layer. Furthermore, material exhibiting relatively high light absorbance or reflectance may be used as filler. In this case, the lateral diffusion of stimulated emission light entering into the phosphor layer, in addition to the foregoing strengthening effect is effectively reduced.

The material exhibiting high reflectance refers to one exhibiting a high reflectance with respect to stimulated emission light (500-900 nm, specifically 600-800 nm), including metals such as aluminum, magnesium, silver, indium, and white pigments and coloring materials ranging green to red. White pigments can also reflect stimulated luminescence.

Examples thereof include $TiO_2$ (anatase type or rutile type) MgO, $PbCO_3.Pb(OH)_2$, $BaSO_4$, $Al_2O_3$, M(II)FX (provided that M(II) is at least one atom selected from the group consisting of Ba, Sr and Ca, X is a Cl atom or a Br atom), $CaCO_3$, ZnO, $Sb_2O_3$, $SiO_2$, $ZrO_2$, lithopone ($BaSO_4.ZnS$), magnesium silicate, basic lead silicosulfate, basic lead phosphate, and aluminum silicate.

These white pigments exhibit high covering power and have a high refractive index, whereby stimulated luminescence is easily scattered through reflection or refraction, leading to enhanced sensitivity of the radiation image conversion panel.

Examples of material exhibiting high light absorbance include carbon black, chromium oxide, nickel oxide, iron oxide and coloring materials of blue. Of these, the carbon black absorbs stimulated luminescence.

Coloring materials may also be organic or inorganic coloring materials.

Examples of organic coloring materials include Zapon fastblue 3G (product of Hoechst Marion Roussel, Ltd.), Estrol Brillblue N-3RL (product of Sumitomo Chemical Co., Ltd.), D&C Blue No. 1 (producy of National Aniline Co.), Spirit Blue (Hodogaya chemical Co., Ltd.), Oilblue No. 603 (product of Orient Co.), Kiton Blue A (product of Ciba-Geigy AG. GmbH.), Aisen Catironblue GLH (Hodogaya Chemical Co., Ltd.), Lakeblue AFH (product of Kyowa Industry Co., Ltd.), Primocyanine 6GX (Inabata & Co., Ltd), Brillacid Green 6BH (product of Hodogaya Chemical Co., Ltd.), Cyanblue BNRCS (product of TOYO INK MFG. CO., LTD.), and Lyonol Blue SL (product of TOYO INK MPG. CO., LTD.).

There are also cited organic complex colorants such as Color Index Nos. 24411, 23160, 74180, 74200, 22800, 23154, 23155, 24401, 14830, 15050, 15760, 15707, 17941, 74220, 13425, 13361, 13420, 11836, 74140, 74380, 74350, and 74460.

Examples of inorganic coloring material include ultramarine, cobalt blue, cerulean blue, chromium oxide, and $TiO_2$—ZnO—Co—NiO type pigments.

Further, the radiation image conversion panel of the present invention may comprise a protective layer.

The protective layer may be formed by directly coating a protective layer coating liquid on the phosphor layer or may be formed via adhesion of a previously formed protective layer onto the phosphor layer. Or a phosphor layer may also be formed on a previously formed protective layer.

As the material of the protective layer, employed are conventional materials for the protective layer such as cellulose acetate, nitrocellulose, poly(methyl methacrylate) poly(vinyl butyral), poly vinyl formal), polycarbonate, polyester, poly ethylene phthalate), polyethylene, poly(vinylidene chloride), Nylon, poly(ethylene fluoride), poly(trifluoroethylen chloride), tetrafluoroethylene-hexafluoropropylene copolymer, vinylidene chloride-vinyl chloride copolymer and vinylidene chloride-acrylonitrile copolymer. A transparent glass plate can also be employed as the protective layer.

The protective layer may be formed via lamination of inorganic materials such as SiC, $SiO_2$, SiN and $Al_2O_3$ by the evaporation method or the sputtering method.

These protective layers preferably have a thickness of 0.1-2,000 μm.

EXAMPLE

Next, the present invention will be described in detail referring to examples, but embodiments of the present invention are not limited thereto.

Example

Preparation of Support

After sputtering each kind of metal layers onto a polymer film shown in the following Table so as to give a layer thickness of 700 A, if desired, a subbing layer having a dry thickness of 1.0 μm is coated via coating and drying of Vylon 200 (produced by Toyobo Co., Ltd.) dissolved in methylethyl ketone, and the resulting was cut into a square 700 mm on a side to prepare the support.

As supports for comparative examples, the support obtained by coating a subbing layer having a dry thickness of 1.0 μm was prepared employing a high reflection aluminum plate having a square 700 mm on a side and a thickness of 0.5 mm (XL, produced by Sumitomo Chemical Co., Ltd., and an amorphous carbon plate having a square 300 mm on a side and a thickness of 1.5 mm (Univeks, produced by Unitika Ltd.).

TABLE 1

<Polymer films>

| Supports | Thickness (μm) | Manufacturers | Products |
|---|---|---|---|
| Polyimide (PI) | 125 | Ube Industries, Ltd. | UPILEX 125S |
| Polyethylene Naphthalate (PEN) | 125 | Teijin DuPont Films Japan Ltd. | TEONEX Q51 |
| Polyethersulfone (PES) | 150 | Sumitomo Bakelite Co. Ltd. | FS-1300 |
| Polyethylene terephthalate (PET) | 125 | Toray Industries, Inc. | LUMIRROR T60 |

Evaporation of Phosphor

Next, large-sized phosphor plates in which stimulable phosphor (CsBr:Eu) is formed on the above-prepared support with an evaporator were prepared.

In order to form the phosphor layer, the inside of a vacuum chamber was once evacuated, and then Ar gas was introduced and adjusted so as to give a vacuum degree of $1.0 \times 10^{-2}$ Pa, and evaporation was carried out until thickness of the phosphor layer reached 150 μm while maintaining the support surface temperature at 100° C.

In a conventional evaporator, a vapor source was placed on a normal line being at right angle to the support center, and distance d1 between the support and the vapor source was set to 60 cm. Evaporation was conducted while rotating the support during evaporation.

<Cutting of Plate>

Four plates having a size of 170 mm×230 mm were cut out of a large-sized phosphor plate having a square 700 mm on a side employing an apparatus of cutting a phosphor plate shown in the FIGURE by laser light. The fourth harmonic wave of Nd:YAG laser (a wavelength of 266 nm) was used as laser to conduct cutting at a pulse energy of 0.1 mJ/pulse and at a pulse width of 50 ns.

<Infrared Laser>

Four plates having a size of 170 mm×230 mm were cut Out of a largesized phosphor plate employing $CO_2$ laser having a laser wavelength of 1060 nm. In addition, oxygen was used as an assist gas, and additional conditions were a gas pressure of 3 kg/cm$^2$, an output power of 100 W, and a frequency of 100 Hz.

<Punching>

Four plates having a size of 170 mm×230 mm were cut out of a largesized phosphor plate by a punching blade via a method described in Japanese Patent O.P.I Publication No. 11-223891.

Sealing of Cut Plate

A moisture-resistant film having the following structure was used in order to protect the phosphor layer side of the above-described phosphor plate having a size of 170 mm×230 mm.

NY15///VMPET12///VMPET12///PET12///CPP20 where NY: Nylon,

PET: Polyethylene terephthalate,

CPP: Casting polypropylene, and

VMPET: Alumina-deposited PET (commercially available, produced by Toyo Metalizing Co., Ltd.)

The number following the name of each resin film represents the resin layer thickness (in μm).

"///" represents a dry lamination adhesive layer of 3.0 μm in thickness. A two liquid reaction type urethane adhesive was used as an adhesive for the utilized dry lamination.

The protective film on the back side of the phosphor plate is a dry lamination film composed of a 30 μm thick CPP film, a 9 μm thick aluminum film, and a 188 μm thick polyethylene terephthalate film. Further, the adhesive layer has a thickness of 1.5 μm, and a two liquid reaction type urethane adhesive was used in this case.

After the cut phosphor plate was prepared, the peripheral portion of the phosphor plate was fused and sealed by an impulse sealer under reduced pressure, employing the moisture-resistant protective film prepared above to obtain the radiation image conversion panel. The impulse sealer used for fusion employed a 3 mm wide heater.

Evaluation Method

<Defect of Phosphor Layer>

The edge of the plate having a size of 170 mm×230 mm which was cut out of a largesized phosphor plate was observed employing an optical microscope to evaluate a defect portion of phosphor (that is, length of the portion in which the support surface is exposed). The defect length of a phosphor layer exceeding 0.5 mm produces a problem in view of product performance.

<Fusion of Columnar Crystal>

The cross-sectional shape of a phosphor layer in the cut plate was observed via SEM photography to evaluate fusion of columnar crystals.

<Thermal Deformation>

Plate deformation, cutting, deformation after sealing, and image unevenness after removing a largesized phosphor plate from a vacuum chamber were visually evaluated. In addition, the plate after sealing was exposed to X-ray at 80 kV·200 mas, and images for unevenness evaluation were read out employing Regius 170 manufactured by Konica Minolta Medical & Graphic, Inc. for evaluation. Evaluation was conducted according to the following criterion.

Ranks A, B and C except D are determined to be practically available.

<Luminance>

Stimulated luminance intensity (luminance) of the sealed phosphor plate described above were measured as described below.

After the entire surface of a radiation image conversion panel is exposed to X-ray at a tube voltage of 80 kVp., the panel was excited by scanning with a semiconductor laser (680 nm) of 100 mW, and the stimulated luminescence emitted from a phosphor layer was received with a photomultiplier tube (manufactured by Hamamatsu Photonics K.K.) to be converted to electrical signals, which were analog/digital converted and recorded on a hard disk.

The signal value of an X-ray plane image recorded on the hard disk was analyzed via a computer to determine the stimulated luminance intensity. Results were described in relative value when Example 1 was set to 100. The value of 80 or more was determined to be practically available.

<Moisture Resistance Test>

After letting the above-described sealed phosphor plate stand for 3 months at a temperature of 40° C. and a high humidity of 90%, a ratio of luminance at the initial stage to luminance after 3 months was calculated. The value approaching 1 means less degradation in luminance. The value of 0.8 or more was determined to be practically available.

TABLE 2

| Example | Substrate | Coated metal | Phosphor | Cutting method | Defect of phosphor layer (mm) | Fusion of phosphor | Thermal deformation | Luminance | Moisture resistance test | Remarks |
|---|---|---|---|---|---|---|---|---|---|---|
| 1 | PI | Sputtered aluminum | CsBr (Evaporation) | UV laser | 0.1 or less | Produced | A | 100 | 0.95 | Inv. |
| 2 | PI | Sputtered silver | CsBr (Evaporation) | UV laser | 0.1 or less | Produced | A | 105 | 0.97 | Inv. |
| 3 | PEN | Sputtered aluminum | CsBr (Evaporation) | UV laser | 0.1 or less | Produced | B | 98 | 0.90 | Inv. |
| 4 | PES | Sputtered aluminum | CsBr (Evaporation) | UV laser | 0.1 or less | Produced | B | 101 | 0.93 | Inv. |
| 5 | PET | Sputtered aluminum | CsBr (Evaporation) | UV laser | 0.1 or less | Produced | C | 97 | 0.94 | Inv. |
| 6 | PI | None | CsBr (Evaporation) | UV laser | 0.1 or less | Produced | B | 82 | 0.90 | Inv. |
| 7 | PI | Sputtered aluminum | CsBr (Evaporation) | Infrared laser | 0.3 | Produced | A | 100 | 0.88 | Inv. |
| 8 | PI | Sputtered aluminum | CsBr (Evaporation) | Punching | 2 | Not produced | A | 100 | 0.65 | Comp. |
| 9 | Amorphous carbon | Sputtered aluminum | CsBr (Evaporation) | UV laser | —** | —** | —** | —** | —** | Comp. |
| 10 | Aluminum | None | CsBr (Evaporation) | Punching | 5 | Not produced | A | 89 | 0.45 | Comp. |
| 11 | Aluminum | None | CsBr (Evaporation) | UV laser | —** | —** | —** | —** | —** | Comp. |

**(non-cuttable),
Inv.: Present invention,
Comp.: Comparative example

Since plural desired-sized phosphor plates have become possible to be cut out of a largesized phosphor plate in the present invention, productivity as an evaporation type phosphor plate issue was able to be largely improved.

As is clear from the above-described result, it is to be understood that the plates of the present invention which were cut out of a largesized phosphor plate are superior to the comparative examples.

Cassettes were prepared employing radiation image conversion panels of the present invention and the comparative examples described above, and the same evaluation was conducted as described above. As a result, it is to be understood that cassettes with radiation image conversion panels of the present invention were superior to comparative cassettes.

[Effect of the Invention]

Excellent effects can be produced by utilizing a radiation image conversion panel of the present invention, and a manufacturing method and a cassette thereof exhibiting no generation of cracks in a phosphor layer, easy cutting, improved image and excellent productivity.

What is claimed is:

1. A radiation image conversion panel comprising a support and provided thereon, a phosphor layer comprising phosphor having a columnar crystal structure, wherein a region in which no phosphor layer is provided on a surface of the support is within 0.5 mm from an edge of the support, and columnar crystals at an edge of the phosphor layer are fused via heat generated by cutting.

2. The radiation image conversion panel of claim 1, wherein the support and provided thereon, the phosphor layer are cut by laser light.

3. The radiation image conversion panel of claim 2, wherein the laser light is UV laser.

4. The radiation image conversion panel of claim 1, wherein the support comprises a metal-coated polymer film.

5. The radiation image conversion panel of claim 4, wherein the metal comprises aluminum or silver as a principal component.

6. The radiation image conversion panel of claim 4, wherein the polymer film is made of any one of polyimide, polyethylene naphthalate, polyethersulfone and polysulfone as a principal component.

7. The radiation image conversion panel of claim 1, wherein the phosphor layer contains the phosphor comprising alkali halide represented by Formula (1) as a principal substance:

$$M^1X \cdot aM^2X'_2 \cdot bM^3X''_3 : eA \qquad \text{Formula (1)}$$

wherein $M^1$ is at least one alkali metal atom selected from the group consisting of Li, Na, K, Rb and Cs; $M^2$ is at least one divalent metal atom selected from the group consisting of Be, Mg, Ca, Sr, Ba, Zn, Cd, Cu and Ni; $M^3$ is at least one trivalent metal atom selected from the group consisting of Sc, Y, La, Ce, Pr, Nd, Pm, Sm, Eu, Gd, Tb, Dy, Ho, Er, Tm, Yb, Lu, Al, Ga and In; X, X' and X" each are at least one halogen selected from the group consisting of F, Cl, Br and I; A is at least one metal atom selected from the group consisting of Eu, Tb, In, Cs, Ce, Tm, Dy, Pr, Ho, Nd, Yb, Er, Gd, Lu, Sm, Y, Tl, Na, Ag, Cu and Mg; and a, b and e each are a value within the range of $0 \leqq a < 0.5$, $0 \leqq b < 0.5$ and $0 < e \leqq 0.2$, respectively.

8. The radiation image conversion panel of claim 1, wherein the phosphor comprises stimulable phosphor

9. A cassette comprising the radiation image conversion panel of claim 1.

* * * * *